US007523839B2

(12) United States Patent
Savicki

(10) Patent No.: US 7,523,839 B2
(45) Date of Patent: Apr. 28, 2009

(54) VENTABLE SPIN LOCK CONTAINER

(75) Inventor: Alan F. Savicki, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 654 days.

(21) Appl. No.: 10/820,616

(22) Filed: Apr. 8, 2004

(65) Prior Publication Data

US 2005/0224498 A1 Oct. 13, 2005

(51) Int. Cl.
*B65D 51/16* (2006.01)
*B65D 41/04* (2006.01)

(52) U.S. Cl. ..... 220/303; 220/366.1

(58) Field of Classification Search ..... 220/303, 220/366.1, 367.1, 288; 215/307, 354, 353, 215/356, 357, 318
See application file for complete search history.

(56) References Cited

U.S. PATENT DOCUMENTS

| | | | | | |
|---|---|---|---|---|---|
| 590,907 | A | * | 9/1897 | Pendleston, Jr | 220/322 |
| 1,365,167 | A | | 1/1921 | Gates | |
| 1,528,566 | A | | 3/1925 | Podel | |
| 2,122,746 | A | | 7/1938 | Kernahan | |
| 2,241,381 | A | | 5/1941 | Hothersall | |
| 2,675,040 | A | | 4/1954 | Raun et al. | |
| 3,128,005 | A | * | 4/1964 | Sherlock | 220/288 |
| 3,362,565 | A | | 1/1968 | McCormick | |
| 3,371,817 | A | | 3/1968 | Gasbarra et al. | |
| 4,136,799 | A | | 1/1979 | Albert | |
| 4,760,936 | A | | 8/1988 | Mueller | |
| 4,967,926 | A | * | 11/1990 | Morris, Sr. | 220/323 |
| 5,147,059 | A | | 9/1992 | Olsen et al. | |
| 5,152,416 | A | * | 10/1992 | Cassel | 220/288 |
| 5,190,181 | A | * | 3/1993 | Budenbender | 220/288 |
| 5,197,620 | A | | 3/1993 | Gregory | |
| 5,310,074 | A | * | 5/1994 | Jochem et al. | 220/296 |
| 5,462,186 | A | | 10/1995 | Ladina et al. | |
| 5,638,976 | A | | 6/1997 | Arnold | |
| 5,894,953 | A | | 4/1999 | Ramirez | |
| 6,085,922 | A | | 7/2000 | Esser | |
| 6,123,212 | A | * | 9/2000 | Russell et al. | 215/330 |
| 6,170,691 | B1 | * | 1/2001 | Morris et al. | 220/304 |
| 6,170,696 | B1 | | 1/2001 | Tucker et al. | |
| 6,227,391 | B1 | * | 5/2001 | King | 215/307 |
| 2002/0148845 | A1 | | 10/2002 | Zettle et al. | |

* cited by examiner

*Primary Examiner*—Anthony D Stashick
*Assistant Examiner*—James N Smalley
(74) *Attorney, Agent, or Firm*—Thomas C. Feix

(57) ABSTRACT

A ventable spin lock container comprising a container member having a bottom, an upper annular rim and a substantially continuous side wall extending from the bottom and terminating at the rim, the bottom and side wall defining a first member cavity, the rim including a first member skirt having a plurality of first threads, the plurality of first threads having substantially equidistant engagement points; and a closure member having a peripheral sealing portion, the sealing portion including a skirt having a plurality of second threads adapted and positioned to cooperate with the first threads, wherein sealable engagement of the container member and closure member is effectuated when the first and second threads are in a first position, and wherein a venting passage from the container member cavity to the container surroundings is provided when the first and second threads are in a second position.

31 Claims, 9 Drawing Sheets

VENTABLE SPIN LOCK CONTAINER

FIELD OF THE PRESENT INVENTION

The present invention relates generally to reclosable containers. More particularly, the invention relates to ventable spin lock container.

BACKGROUND OF THE INVENTION

Thermoplastic containers are well known in the art. The noted containers generally include a lid that is selectively detachable from a bowl and are commonly designed to provide a variety of features, including being reusable, disposable, microwavable, and the like.

Numerous types of bowl and lid assemblies and means for effecting sealable engagement of a lid on a bowl have been devised. Illustrative are the containers and engagement means disclosed in U.S. Pat. No. 6,170,696.

One problem associated with a conventional, microwavable container stems from the rapid temperature changes that it must endure. The container must be permitted to vent during microwaving due to the high pressures that arise as moisture in the container contents vaporizes and gas temperatures increase. Thus, the container must be left open to some degree during microwaving. However, it is also desirable to keep the bowl covered as much as possible to prevent the contents from splattering the inside of the microwave.

One common practice is to remove the lid and place it loosely over the container bowl so that air and steam can escape during microwaving. Another common practice is to only partially remove the lid (i.e., "crack open" the lid) by disengaging only part of the lid from the bowl. Both of these practices generally permit sufficient air and steam to vent during microwaving because the increased pressure within the container will tend to force the container open, increasing any space between the lid and the bowl. However, once microwaving is complete, the steam will cool and the pressure in the container will drop significantly. Because the pressure differential no longer tends to open the container, the above-noted venting practices often do not permit sufficient air to vent back into the container to compensate for the pressure drop. This problem can be aggravated by the accumulation of steam or vapor, which can form a vapor seal between the lid and bowl. A vacuum can result, and the container can be damaged and could ultimately implode.

Various container designs have been employed to provide venting. For example, in U.S. Pat. No. 3,362,565 a lid is disclosed that includes a sidewall, which has a sealing bead near the base and a shoulder near the top. The sealing bead seals against an internal shoulder provided in a container. Notches are intermittently disposed about an outer periphery of the sealing bead. These notches provide a venting passageway through which gases generated in a sealed container can escape when the gas or vapor pressure is sufficient to flex the lid upward at its center, causing a fulcruming action.

In U.S. Pat. No. 5,147,059 a lid is disclosed having a series of vent-defining protuberances on the inner surface of a vertical, outer sealing portion of a lid. The protuberances engage a container rim to permit venting when the lid is loosely placed on the container. The venting prevents internal/external pressure differentials that might resist the proper seating and removal of the lid.

There are several drawbacks and disadvantages associated with prior art container venting means. A major drawback is that the prior art venting means typically include complex design features that are difficult to manufacture. Lids employing the complex design features are thus quite costly.

It would thus be advantageous to provide a ventable spin lock container having a lid (i) that is adapted to selectively tightly seal the container in a first position and provide effective means for venting the container at a second, partially opened position and (ii) can be readily manufactured via a conventional thermoforming process.

SUMMARY OF THE INVENTION

The ventable spin lock container in accordance with one embodiment of the invention comprises a container member having a bottom, an upper annular rim and a substantially continuous side wall extending from the bottom and terminating at the rim, the bottom and side wall defining a first member cavity, the rim including a first member skirt having a plurality of first threads, the plurality of first threads having substantially equidistant engagement points; and a closure member having a peripheral sealing portion, the sealing portion including a skirt having a plurality of second threads adapted and positioned to cooperate with the first threads, wherein sealable engagement of the container member and closure member is effectuated when the first and second threads are in a first position, and wherein a venting passage from the container member cavity to the container surroundings is provided when the first and second threads are in a second position.

In one embodiment of the invention, the plurality of first and second threads comprises eight threads. Preferably, each of the threads has an inclination angle in the range of approximately 5-10°.

In one embodiment, each of the plurality of second threads comprises a raised projection that projects inwardly from the closure member skirt and each of the plurality of first threads comprises a guide adapted to receive one of the plurality of second threads.

In an alternative embodiment, each of the plurality of first threads comprises a raised projection that projects outwardly from the container member skirt and each of the plurality of second threads comprises a guide adapted to receive one of the plurality of threads.

In another embodiment of the invention, a closure system for closing an opening in a container is provided, the closure system comprising a substantially U-shaped circumferentially extending guiding channel defined by an inner wall and an outer wall that are located and configured to receive between them the sealing member of the container, the sealing member having a corresponding configuration as the guiding channel and including an inner wall and an outer wall, the guiding channel inner wall and the container sealing member inner wall being tapered in the range of approximately 5-10°, the guiding channel outer wall including a plurality of first threads having substantially equidistant engagement points, the sealing member outer wall having a plurality of second threads adapted and positioned to cooperate with the first threads.

In another embodiment of the invention, the closure system comprises a substantially U-shaped circumferentially extending guiding channel defined by an inner wall and an outer wall that are located and configured to receive between them the sealing member of a container, the sealing member having a corresponding configuration as the guiding channel and including an inner wall and an outer wall, the guiding channel inner wall and the container sealing member inner wall being tapered in the range of approximately 5-30°, the guiding channel inner wall including a plurality of first threads having substantially equidistant engagement points, the sealing member inner wall having a plurality of second threads adapted and positioned to cooperate with the first threads.

In a further embodiment of the invention, the closure system comprises a substantially U-shaped circumferentially extending guiding channel defined by an inner wall and an outer wall that are located and configured to receive between them the sealing member of a container, the sealing member having a corresponding configuration as the guiding channel and including an inner wall and an outer wall, the guiding channel inner wall and the container sealing member inner wall being tapered in the range of approximately 5-30°, the guiding channel outer wall including a plurality of first threads having substantially equidistant engagement points, the sealing member outer wall having a plurality of second threads adapted and positioned to cooperate with the first threads, wherein the guiding channel inner wall and the container sealing member inner wall providing sealing means when the first and second threads are in an engaged position.

In yet another embodiment, the closure system comprises a substantially U-shaped circumferentially extending guiding channel defined by an inner wall and an outer wall that are located and configured to receive between them the sealing member of a container, the sealing member having a corresponding configuration as the guiding channel and including an inner wall and an outer wall, the guiding channel inner wall and the container sealing member inner wall being tapered in the range of approximately 5-30°, the guiding channel inner wall including a plurality of first threads having substantially equidistant engagement points, the sealing member inner wall having a plurality of second threads adapted and positioned to cooperate with the first threads, wherein the guiding channel inner wall and the container sealing member inner wall providing sealing means when the first and second threads are in an engaged position.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Before describing the present invention in detail, it is to be understood that this invention is not limited to particularly exemplified container lid designs, configurations or sizes, materials and methods as such may, of course, vary. Thus, although a number of container lid designs and configurations similar or equivalent to those described herein can be used in the practice of the present invention, the preferred container lid designs and configurations are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patent and patent applications cited herein, whether supra or infra, are hereby incorporated by reference in their entirety.

Finally, as used in this specification and the appended claims, the singular forms "a "an" and "the" include plural referents unless the content clearly dictates otherwise. Thus, for example, reference to "a thread" includes two or more such threads; reference to "a guide" includes two or more such guides and the like.

The present invention substantially reduces or eliminates the disadvantages and drawbacks associated with prior art thermoformed container bowl and lid assemblies. As discussed in detail herein, the ventable spin lock container of the invention generally includes engagement means comprising a bowl having a plurality of threads disposed proximate the rim of the container bowl and a lid having a matching, but inverted, plurality of cooperating threads formed on the lid inner skirt. The noted engagement means also includes venting means that allows a consumer to position the lid for venting during microwave heating and cooling thereafter.

As discussed in detain herein, the thread design and orientation of the invention provides numerous advantages, including: (i) thread engagement with minimal pre-rotation and (ii) minimizes the amount of undercut that is required to be addressed when ejecting the finished component from the forming tool during a thermoforming process.

Figure 1:
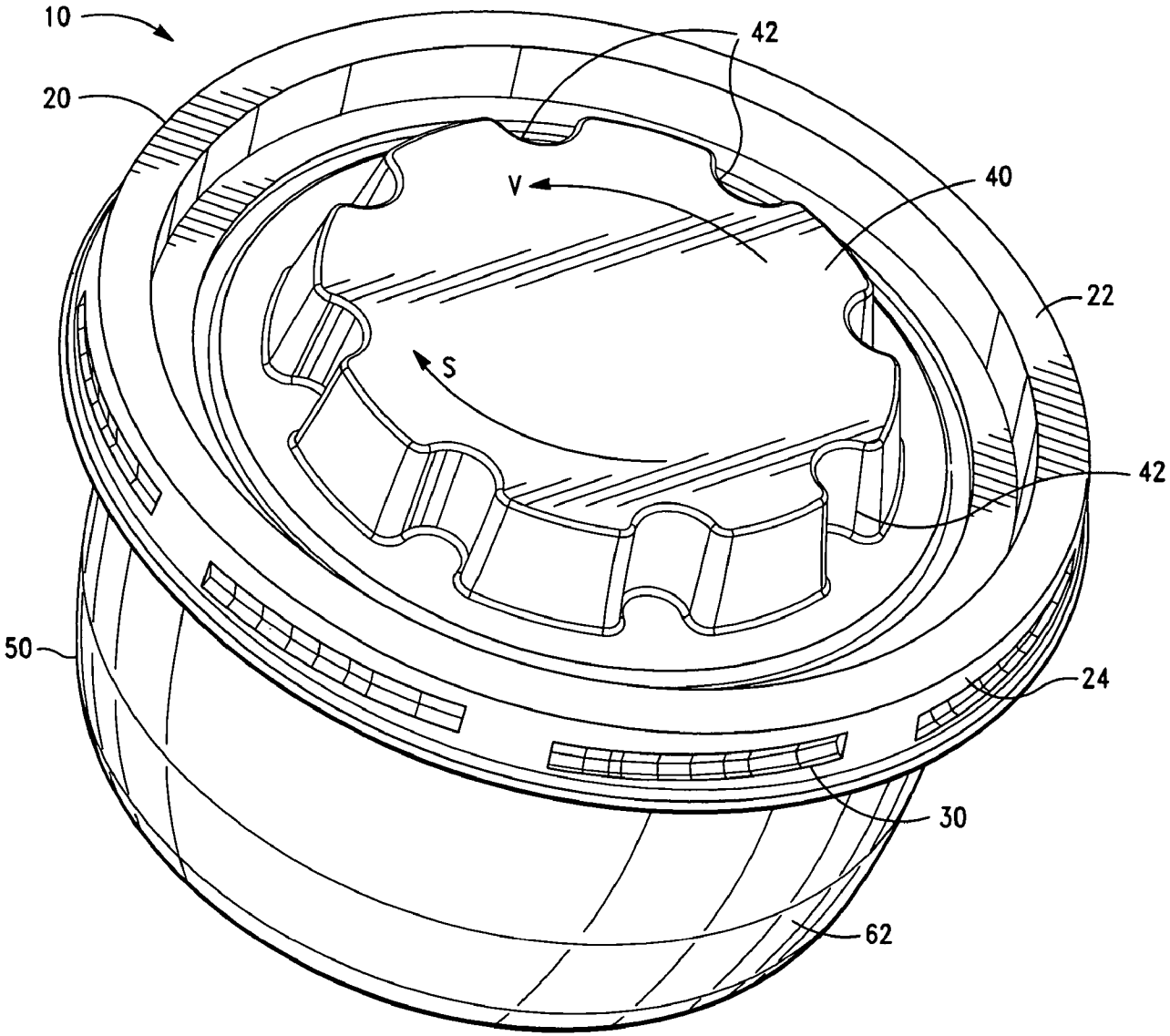
FIG. 1 is a perspective view of a ventable container, according to the invention.
Figure 2:
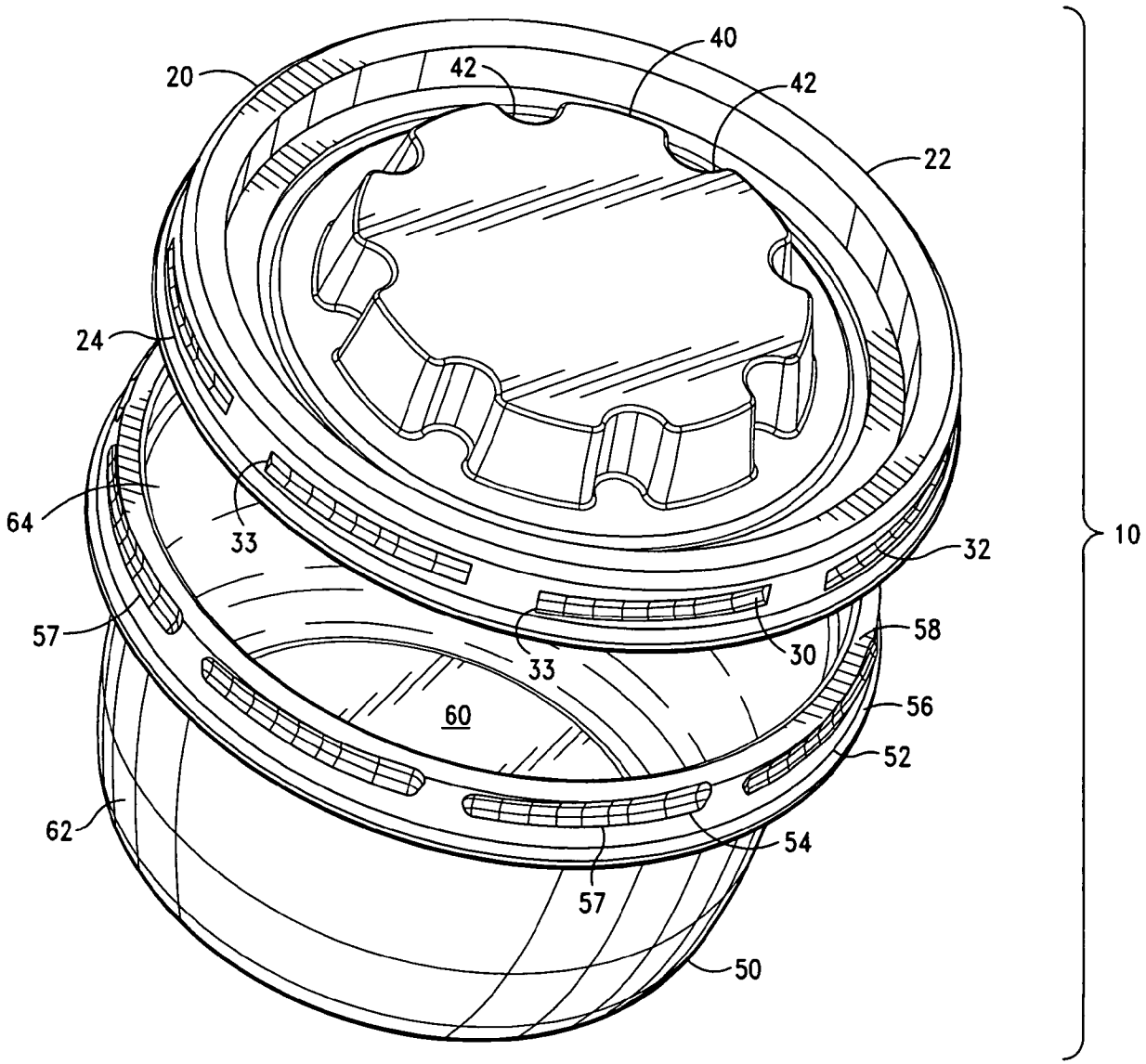
FIG. 2 is an exploded view of the container shown in FIG. 1, illustrating the container lid and bowl.

Referring now to FIGS. 1 and 2, there is shown one embodiment of the ventable spin lock container, designated generally 10. As illustrated in FIG. 1, the container 10 includes a bowl 50 and a selectively detachable, cylindrical lid 20.

As stated, although the invention is described with respect to a cylindrical bowl and lid assembly, the engagement and venting means of the spin lock container can be employed on various containers having cylindrical openings. Such containers include, by way of example, soda bottles, milk containers, bleach bottles, etc.

As will be appreciated by one having ordinary skill in the art, numerous suitable materials may be chosen to fabricate the ventable spin lock container of the invention. Preferably, the container comprises polyolefin or like material.

The noted material is sufficiently resiliently deformable to facilitate cooperation between the lid and bowl threads 30, 54. The noted material also readily accommodates the preferred thermoforming process.

Figure 3:
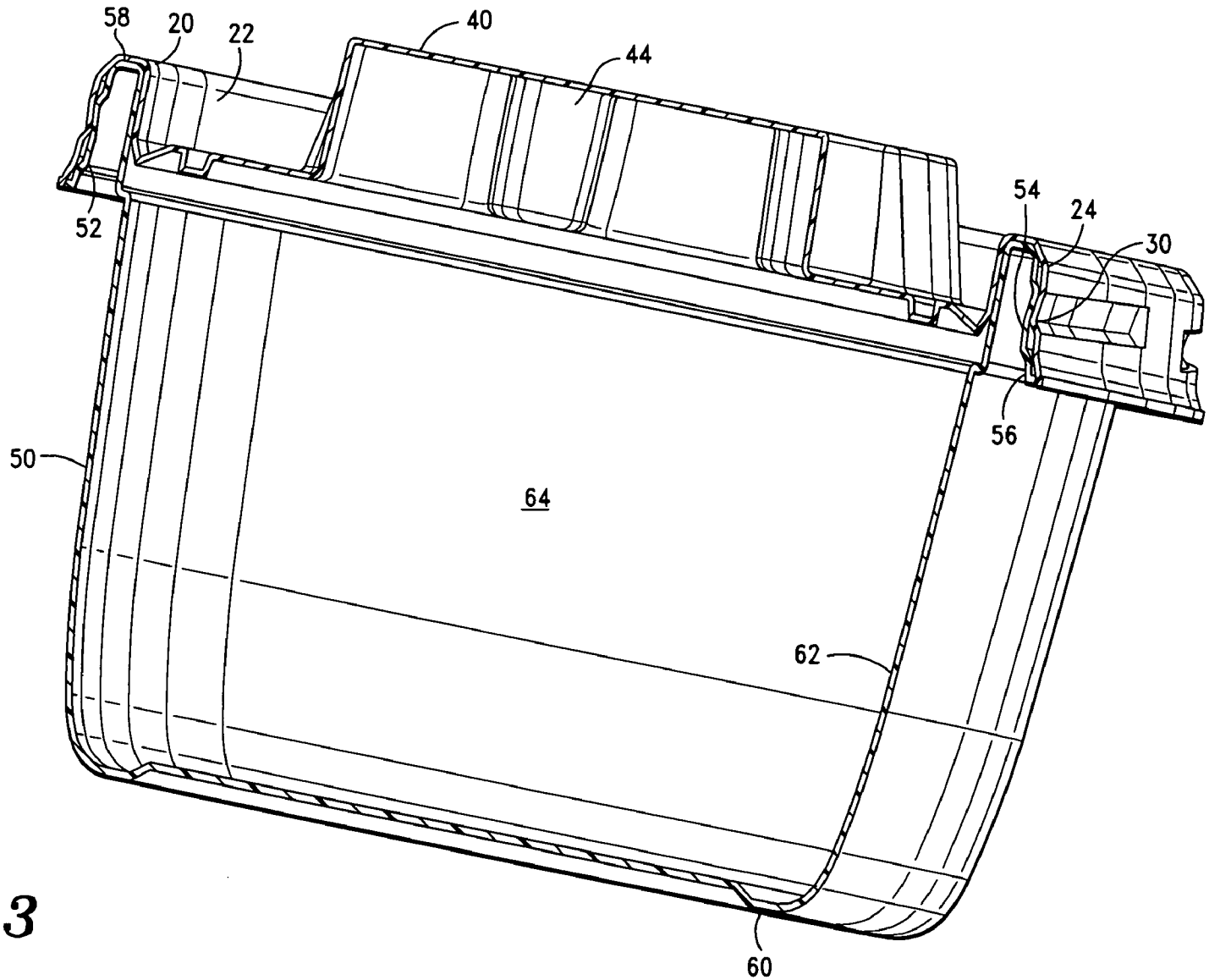
FIG. 3 is a perspective, sectioned view of the container shown in FIG. 1.
Figure 7:
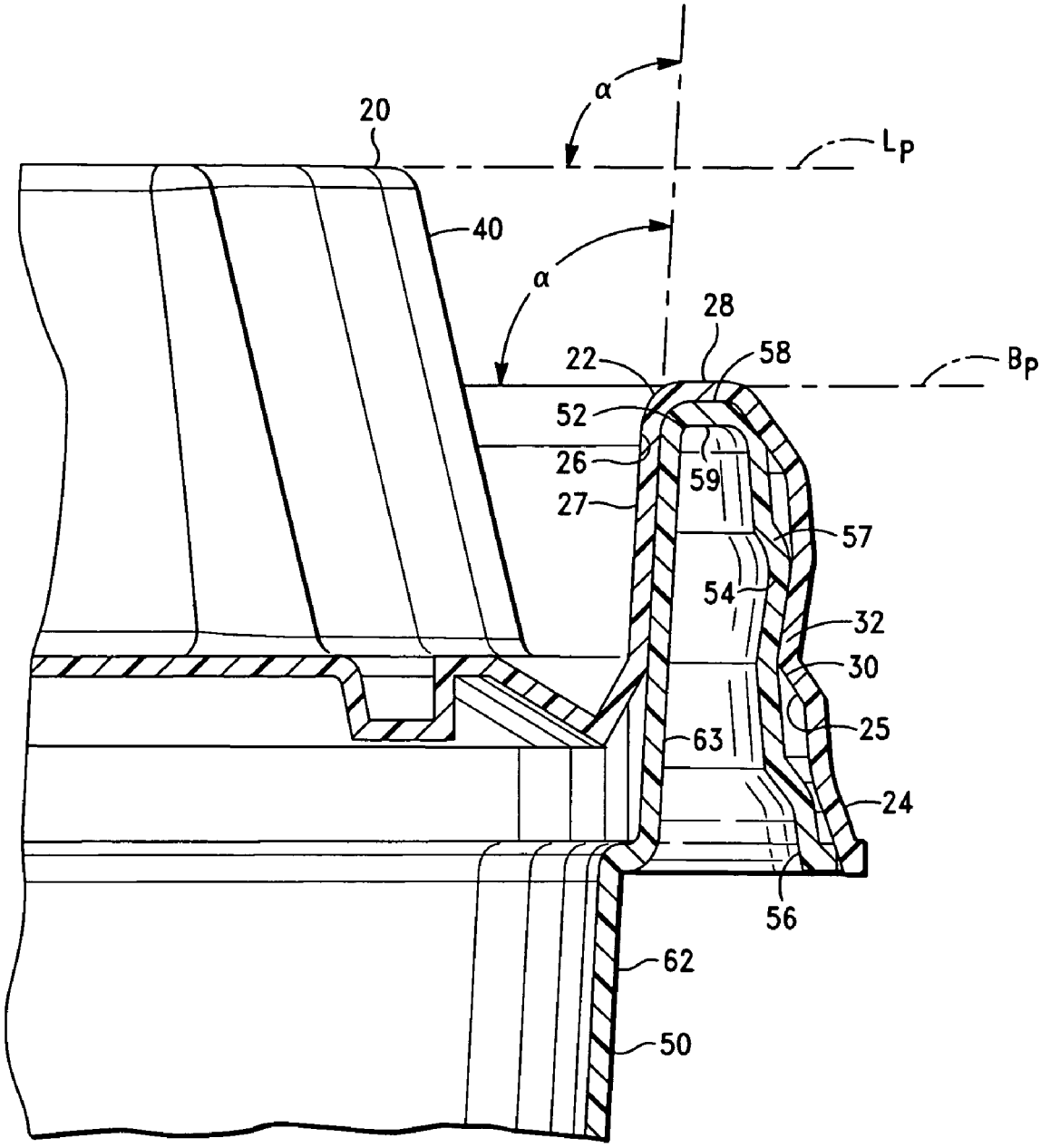
FIG. 7 is a partial front plane, sectioned view of the container shown in FIG. 1, illustrating the engagement of the lid and bowl threads, according to the invention.

Referring to FIGS. 3 and 7, the lid 20 has a peripheral sealing lid or end portion 22 with the cylindrical skirt 24 depending therefrom. As illustrated in FIG. 3, the lid skirt 24 has an interior diameter corresponding to the exterior diameter of the cylindrical mouth 52 of the bowl 50.

Referring now to FIGS. 6A-6C and 7, the end portion 22 of the lid 20 is provided with an inner skirt portion 26 having an inner wall 27 and a circumferentially extending bead 28. The inner surface 25 of the lid skirt 24, which is disposed in the inner skirt portion 26, includes a plurality of threads 30 that are adapted to cooperate with the threads 54 disposed on the bowl skirt 56 (see also FIGS. 1 and 3).

Referring now to FIG. 7, the inner wall 27 is preferably tapered (or flared) outwardly with respect to the horizontal plane (designated "$L_p$") defined by the surface of the lid 20. More preferably, the inner wall 27 forms an angle a in the range of 95-120°, even more preferably, in the range of approximately 95-100° with respect to the noted horizontal plane of the lid 20.

Figure 4:
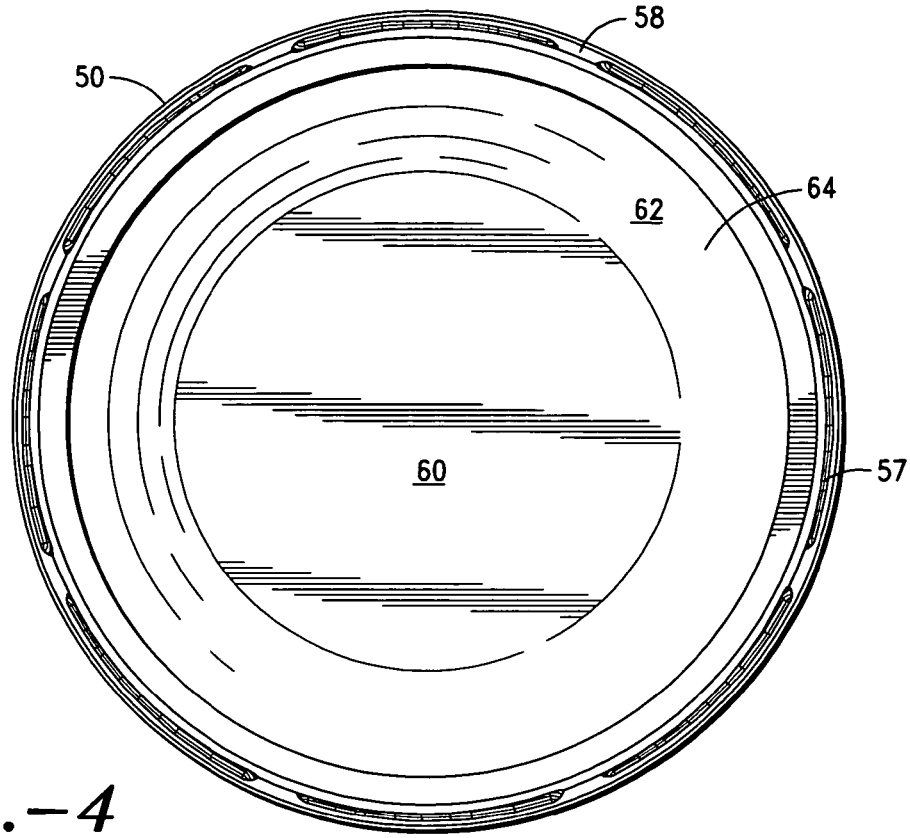
FIG. 4 is a top plane view of the container bowl.
Figure 5:
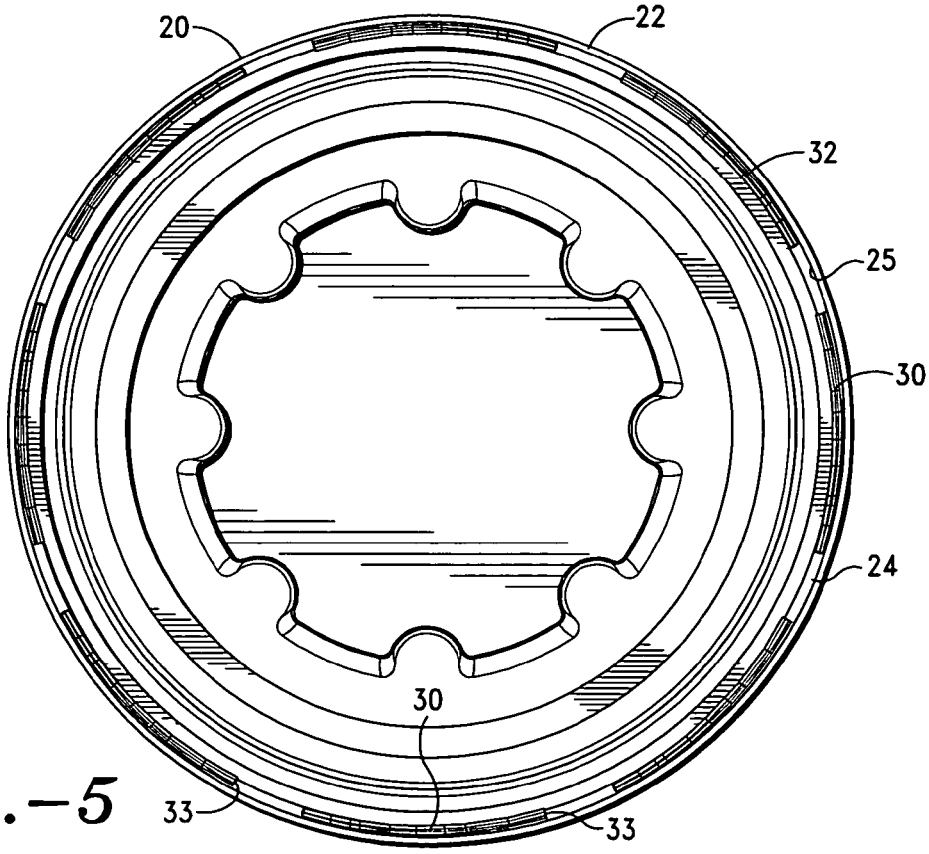
FIG. 5 is a bottom plane view of the container lid.
Figure 6A:
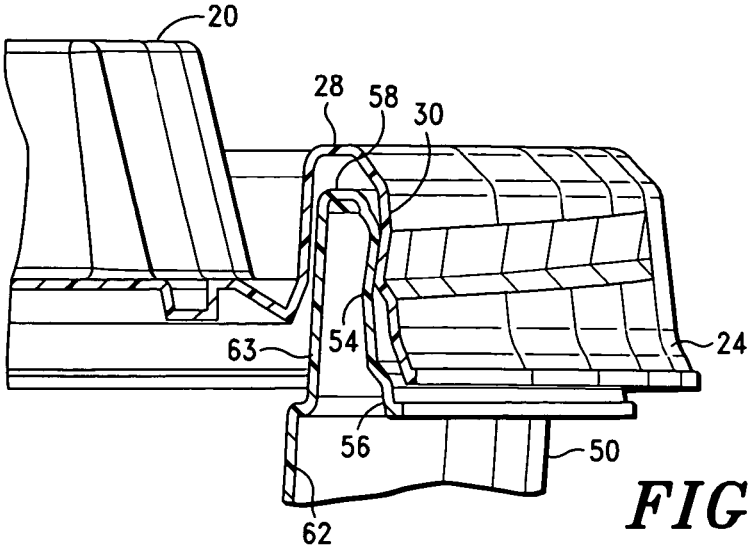
FIGS. 6A-6C are partial perspective, sectioned views of the container shown in FIG. 1, illustrating a series of engagement positioned of the lid to the bowl, according to the invention.
Figure 6B:
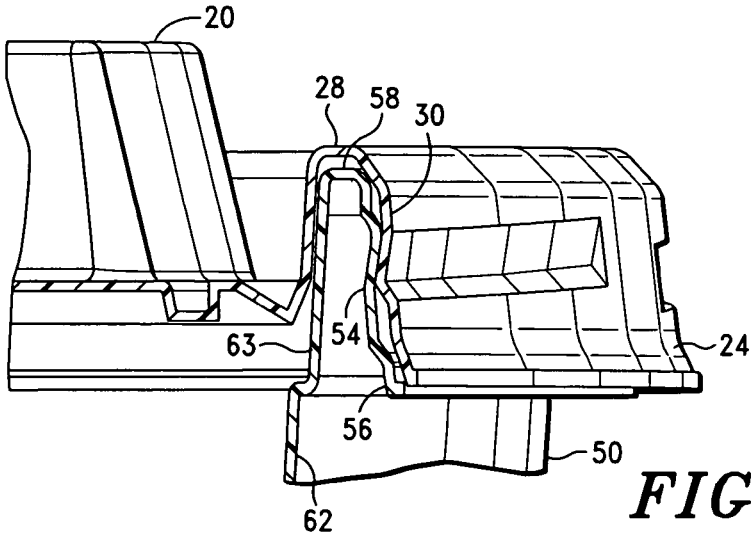
Figure 6C:
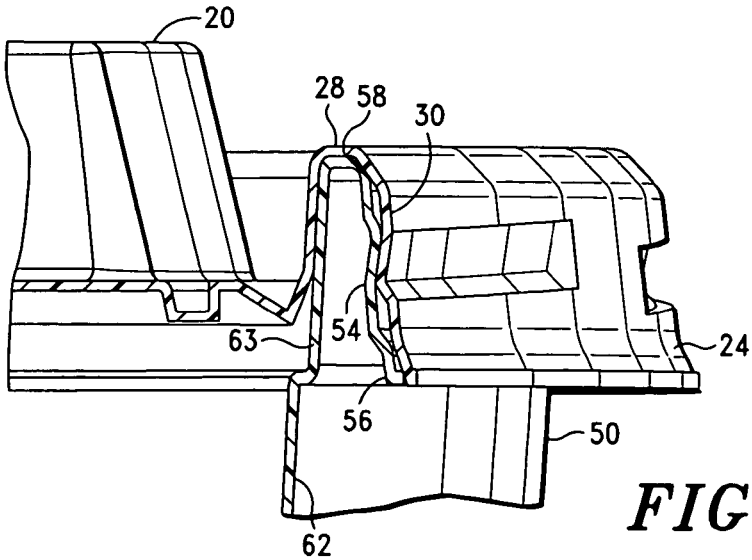

In a preferred embodiment, the lid threads 30 comprise a plurality of raised projections 32 that project from the inner skirt surface 25 (see FIG. 4). According to the invention, the raised projections 32 can comprise various profiles or shapes, such as angular (as shown in FIG. 7), curved, rounded, etc; provided, the bowl threads 54 (i.e., tracks or guides 57), which are discussed in detail below, have a shape that readily engages and cooperates with the projections 32.

As illustrated in FIG. 7, the inner wall 63 of the bowl rim 58 (or sealing member) is similarly tapered outwardly with respect to the horizontal plane (designated "$B_p$") defined by the bowl rim 58. Preferably, the inner wall 63 forms a corresponding angle in the range of approximately 95-120°, more preferably, in the range of approximately 95-100° with respect to the noted horizontal plane of the bowl 50.

According to the invention, the noted corresponding lid and bowl inner wall 27, 63 tapers effectuate sealable engagement of the lid 20 to the bowl 50 upon engagement of the threads 30, 54 and rotation of the lid 20 on the bowl 50. The lid and bowl inner wall 27, 63 tapers further facilitate smooth engagement of the threads 30, 54 and, as discussed in detail below, are a contributing factor toward the unique venting means of the invention.

According to the invention, the number of raised projections 32 can vary from two to twelve (or more). In a preferred embodiment, the lid 20 includes eight (8) equidistantly spaced projections 32, having a circumferential angle between neighboring engagement points 33 preferably in the range of approximately 20-45° , more preferably, in the range of approximately 30-40°.

In the illustrated embodiment, each projection 32 preferably has an axial inclination (i.e., angle relative to the horizontal plane $L_p$ of the lid 20) in the range of approximately 5-20°. More preferably, each projection 32 has an axial inclination in the range of approximately 5-10°.

The axial inclination and length of the projections 32 can of course be varied to facilitate the number of threads employed and provide various engagement parameters, e.g., angular rotation to effectuate sealable engagement.

According to the invention, each projection 32 projects outwardly from the skirt surface 25 a maximum of approximately 0.005-0.030 in., more preferably, a maximum of approximately 0.005-0.010 in., and has a maximum cross section in the range of approximately 0.010-0.040 in., more preferably, in the range of approximately 0.010-0.020 in. (see FIG. 7).

Referring back to FIGS. 1 and 2, the lid 20 preferably includes a raised portion 40 or embossment proximate the center of the lid 20. As illustrated in FIG. 1, the embossment 40 includes a plurality of recessed regions 42 to facilitate rotation of the lid 20 by a consumer.

Referring now to FIGS. 2 through 4, the bowl 50 generally includes a bottom 60 and a continuous sidewall 62 extending from the bottom 60 to define a bowl cavity 64. The top of the sidewall 62 terminates in a substantially continuous rim 58, which defines the mouth 52 of the bowl 50.

As illustrated in FIGS. 3 and 7, the bowl rim 58 is preferably substantially U-shaped in cross section and includes an inner wall 63, an annular flange 59, which extends outwardly from the inner wall 63, and the above discussed skirt 56, which extends downwardly from the annular flange 59.

According to the invention, the bowl skirt 56 includes a corresponding number of threads 54 as the lid threads 30. In the illustrated embodiment, the bowl skirt 56 includes eight (8) equidistantly spaced threads 54 (see FIG. 4).

As illustrated in FIGS. 2 and 7, the threads 54 preferably comprise a plurality of tracks or guides 57 adapted to receive the lid threads 30 (i.e., raised projections 32) and provide a venting air passage when the lid 20 is in a second (or venting) position (discussed below).

According to the invention, the guides 57 can comprise various profiles or shapes, such as angular (as shown in FIGS. 6 and 7), curved or rounded, etc.; provided (i) the guides 57 have a profile that readily engages and cooperates with the raised projections 32 of the lid 20 and (ii) provide the venting air passage when the lid 20 is in a venting position.

As stated, a key feature of the present invention is the provision of a highly effective, simple to operate venting means. According to the invention, the venting means permits sufficient air and steam to vent from the inner volume of the container 10 during microwaving. The venting means also permits sufficient air to vent back into the container 10 after microwaving (i.e., cooling) to compensate for the pressure drop.

Figure 8:
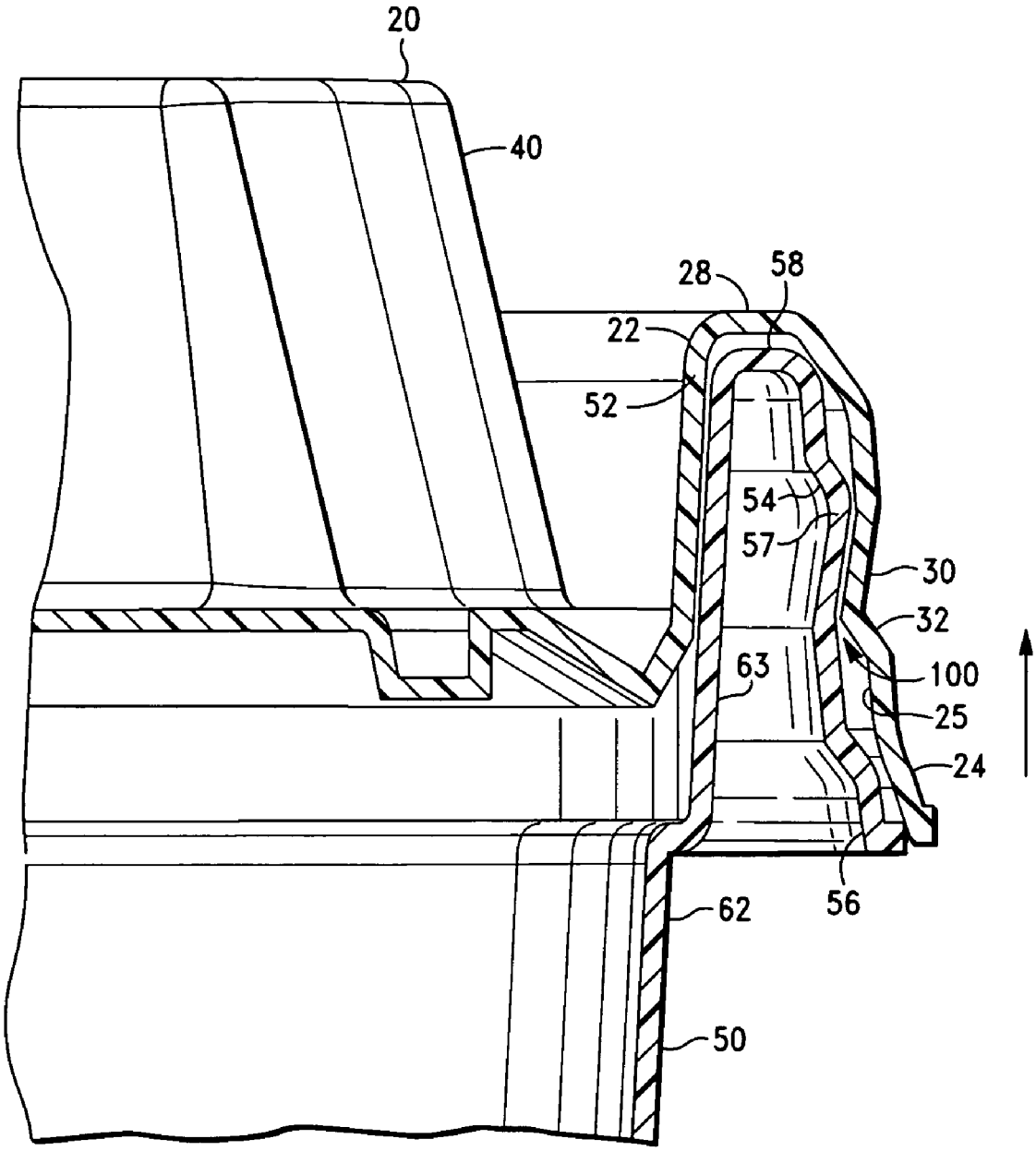
FIG. 8 is a partial front plane, sectioned view of the container shown in FIG. 1, illustrating the lid and bowl threads in a venting position, according to the invention.

Referring to FIG. 8, in a preferred embodiment, the venting means is provided at a predetermined lid 20 rotation wherein the threads 30, 54 are in a loosely engaged position to secure the lid 20 to the bowl 50. However, at the predetermined lid position, by virtue of the lid and bowl skirt 24, 56 tapers and the design and orientation of the cooperating threads 30, 54, an effective air passage from the inner volume of the container 10 or bowl cavity 64 to the container surroundings is provided proximate the thread surfaces (denoted generally 100).

Sealable engagement of the lid 20 and bowl 50 and operation of the venting means will now be described. The lid 20 is initially placed on the bowl 50. The lid 20 is then rotated in a first direction (denoted by arrow "S" in FIG. 1) on the stationary bowl 50, wherein the lid and bowl threads 30, 54 engage (see FIG. 6A). The lid 20 is further rotated in the same direction to a first position shown in FIGS. 1 and 7, wherein the lid 20 is sealably engaged to the bowl 50 (see FIG. 6C).

Prior to microwaving, the lid 20 is merely rotated in a second direction (denoted by arrow "V") to a second position, (shown in FIGS. 6B and 8), wherein the cooperating threads 30, 54 provide the air passage 100 and, hence, venting means discussed above.

Figure 9:
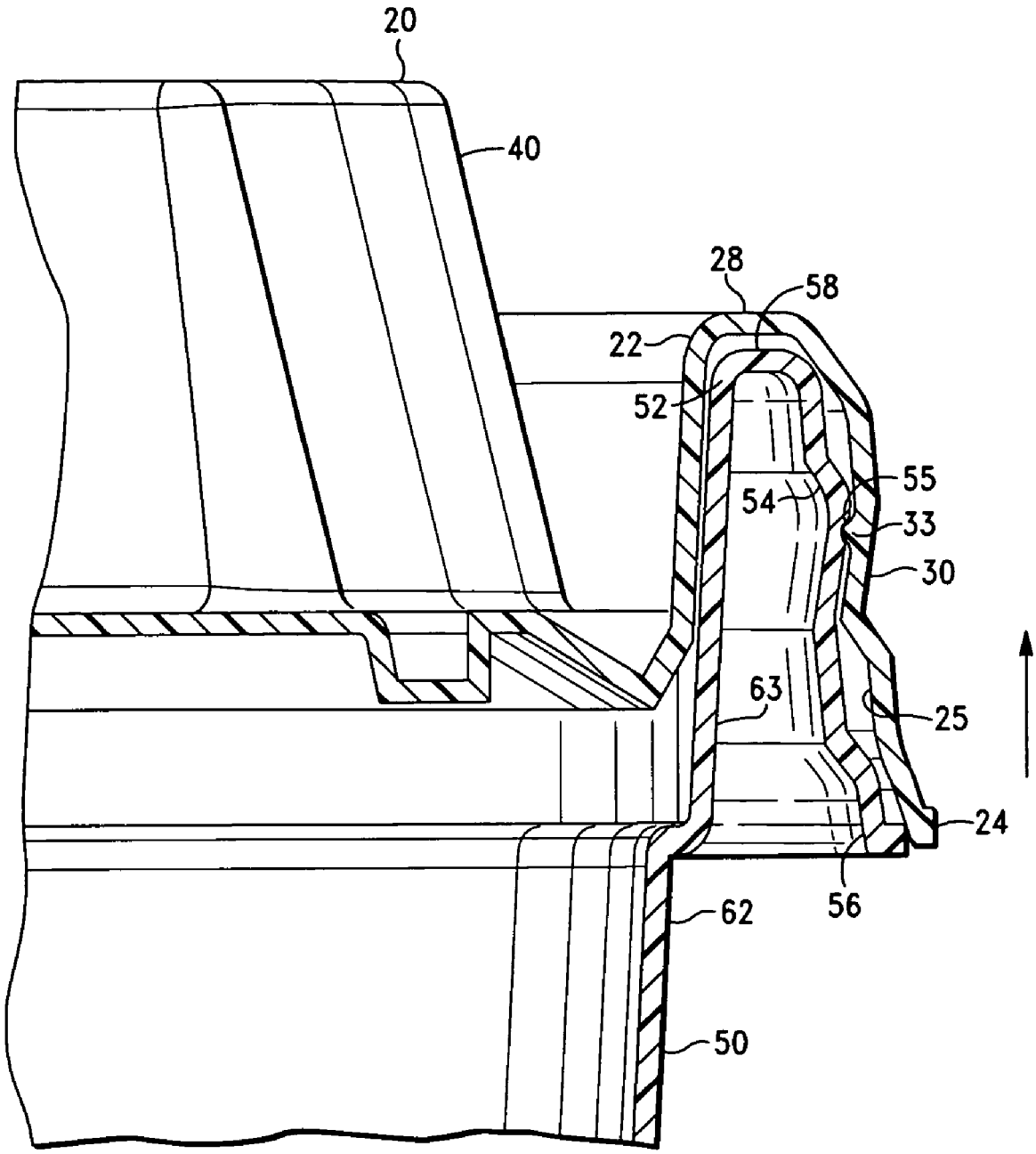
FIG. 9 is a partial front plane, sectioned view of another embodiment of a container having venting position indication means, according to the invention.

Referring now to FIG. 9, in another embodiment of the invention, at least one raised protuberance 33 is provided on at least one lid thread 30 and at least one cooperating seat or notch 55 is provided on at least one bowl thread 54, the seat 55 being designed and positioned to engage the protuberance 33 when the lid 20 is in the second or lid venting position. The engagement of the protuberance 33 in the seat 55 thus defines the lid venting position and ensures that the lid 20 does not unintentionally move from the venting position. The engagement of the protuberance 33 in the seat 55 during rotation of the lid 20 would also provide a tactile indication for the consumer when the lid 20 is in a safe, effective venting position.

As will be appreciated by one having ordinary skill in the art, the location of the projections 32 and guides 57 can be reversed, i.e., the bowl threads 54 comprising the projections 32 and the lid threads comprising the guides 57.

Figure 10:
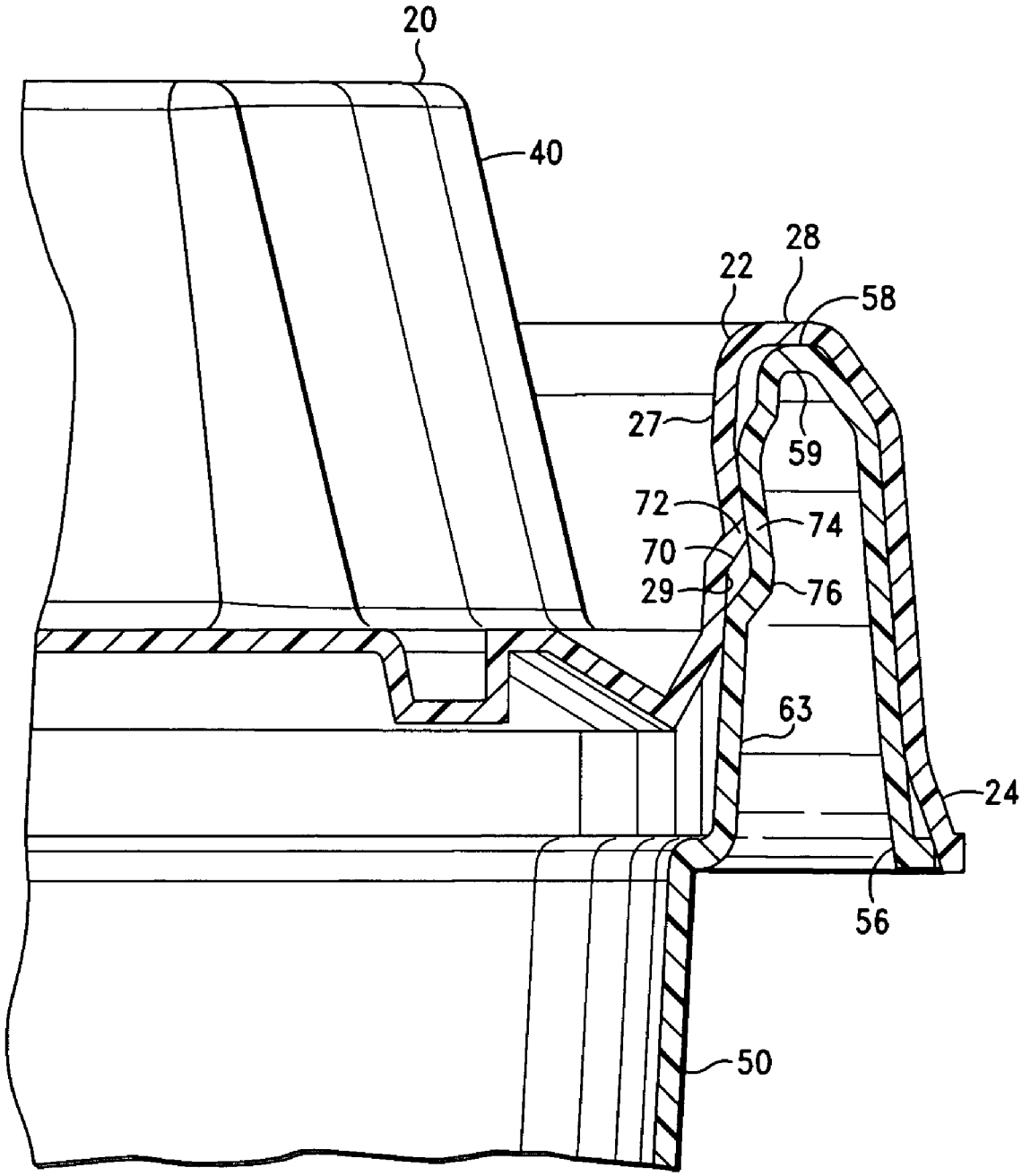
FIG. 10 is a partial front plane, sectioned view of a further embodiment of a container having threads disposed on the inner walls, according to the invention.

Referring now to FIG. 10, there is shown yet another embodiment of the invention. In the noted embodiment, a plurality of threads 70 are disposed of the inner wall 27 of the lid inner skirt portion. As illustrated in FIG. 10, the inner wall 63 of the bowl rim 58 includes a corresponding number of threads 74 as the lid threads 70.

The lid threads 70 similarly, preferably comprise a plurality of raised projections 72 that project outwardly from the inner wall 27 inner surface 29.

As illustrated in FIG. 10, the bowl threads 74 preferably comprise a plurality of tracks or guides 76 adapted to receive the raised projections 72.

According to the invention, the threads 70, 74 would include all the design features and parameters as the aforementioned threads 30, 54.

The configuration of the threads 70, 74 can also similarly be reversed, i.e., the bowl threads 74 comprising raised projections and the lid threads 70 comprising guides.

As will further be appreciated by one having ordinary skill in the art, by virtue of the short length of the container threads 30, 54 and/or 70, 74, the rotative travel of the lid 20 that is necessary to close, vent and open the container 10 is small, thereby allowing quick and agronomical operation by a consumer.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A ventable container, comprising:

a container member having a bottom, an upper annular rim and a substantially continuous side wall extending from said bottom and terminating at said rim, said bottom and side wall defining a first member cavity, said rim including an inner wall and a skirt, said skirt having a plurality of first threads, wherein said plurality of first threads are discontinuous around the container member, said plurality of first threads comprises at least two threads and said plurality of first threads has substantially equidistant engagement points, said inner wall of said container member having a length extending in a substantially vertically downward direction sufficient to define a first sealing surface such that a portion of said first sealing surface and said plurality of first threads are located substantially in a common horizontal plane, and a closure member having a peripheral sealing portion, said sealing portion including an inner wall and a skirt, said skirt having a plurality of second threads adapted and positioned to cooperate with said first threads, wherein said plurality of second threads are discontinuous around the closure member and said plurality of second threads comprises at least two threads, said inner wall of said closure member having a length extending in a substantially vertically downward direction sufficient to define a second sealing surface such that a portion of said second sealing surface and said plurality of second threads are located substantially in a common horizontal plane, wherein sealable engagement of said container member and closure member is effectuated when said first and second threads are in a first position with said first sealing surface in contact with said second sealing surface over a substantial length thereof, and wherein a venting passage from said container member cavity to the container surroundings is provided when said first and second threads are in a second position.

2. The container of claim 1, wherein said container member has a first substantially horizontal plane define by said container member rim and said closure member has a second substantially horizontal plane defined by said peripheral sealing portion.

3. The container of claim 2, wherein said container member inner wall forms an angle in the range of 95-120° with respect to said first horizontal plane.

4. The container of claim 2, wherein said closure member inner wall forms an angle in the range of 95-120° with respect to said second horizontal plane.

5. The container of claim 1, wherein said plurality of first and second threads comprises eight threads.

6. The container of claim 5, wherein each of said plurality of first and second threads has an inclination angle in the range of approximately 5-10°.

7. The container of claim 1, wherein each of said plurality of second threads comprises a raised projection that projects inwardly from said closure member skirt.

8. The container of claim 7, wherein each of said plurality of first threads comprises a guide adapted to receive one of said plurality of second threads.

9. The container of claim 1, wherein each of said plurality of first threads comprises a raised projection that projects outwardly from said container member skirt.

10. The container of claim 9, wherein each of said plurality of second threads comprises a guide adapted to receive one of said plurality of first threads.

11. The container of claim 1, wherein said ventable container includes hindering means for providing a tactile indication of said second position during rotation of said closure member on said container member.

12. The container of claim 11, wherein said hindering means includes at least one proturbance disposed on at least one of said plurality of second threads and at least one recess disposed on at least one of said plurality of first threads, said recess being adapted to receive said proturbance when said plurality of first and second threads are engaged and in said second position.

13. The container of claim 1, wherein said first container member comprises a bowl.

14. The container of claim 13, wherein said closure member comprises a cooperating lid.

15. The container of claim 1, wherein said container member and closure member comprise polyolefin or like material.

16. A closure system for closing an opening in a container, the container having a sealing member adjacent the opening, comprising:

a substantially U-shaped circumferentially extending guiding channel defined by an inner wall and an outer wall that are located and configured to receive between them the sealing member of the container, said sealing member having a corresponding configuration as said guiding channel and including an inner wall and an outer wall, said guiding channel inner wall and said container sealing member inner wall being tapered in the range of approximately 5-30°, said guiding channel outer wall having a plurality of first threads, wherein said plurality of first threads are discontinuous around the guiding channel outer wall, said plurality of first threads comprises at least two threads and said plurality of first threads has substantially equidistant engagement points, said guiding channel inner wall having a length extending in a substantially vertically downward direction sufficient to define a first sealing surface such that a portion of said first sealing surface and said plurality of first threads are located substantially in a common horizontal plane, said sealing member outer wall having a plurality of second threads adapted and positioned to cooperate with said first threads, wherein said plurality of second threads are discontinuous around the sealing member outer wall, and said plurality of second threads comprises at least two threads, said sealing member inner wall having a length extending in a substantially vertically downward direction sufficient to define a second sealing surface such that a portion of said second sealing surface and said plurality of second threads are located substantially in a common horizontal plane, wherein sealable engagement of said guiding channel and sealing member is effectuated when said first and second threads are in a first position with said first sealing surface in contact with said second sealing surface over a substantial length thereof.

17. The closure system of claim 16, wherein each of said plurality of first threads comprises a raised projection that projects inwardly from said guiding channel outer wall.

18. The closure system of claim 17, wherein each of said plurality of second threads comprises a guide adapted to receive one of said plurality of first threads.

19. The closure system of claim 16, wherein each of said plurality of second threads comprises a raised projection that projects outwardly from said sealing member outer wall.

20. The closure system of claim 19, wherein each of said plurality of first threads comprises a guide adapted to receive one of said plurality of second threads.

21. A closure system for closing an opening in a container, the container having a sealing member adjacent the opening, comprising:

a substantially U-shaped circumferentially extending guiding channel defined by an inner wall and an outer wall that are located and configured to receive between them the sealing member of the container, said sealing member having a corresponding configuration as said guiding channel and including an inner wall and an outer wall, said guiding channel inner wall and said container sealing member inner wall being tapered in the range of approximately 5-30°, said guiding channel inner wall having a plurality of first threads, wherein said plurality of first threads are discontinuous around the guiding channel inner wall, said plurality of first threads comprises at least two threads and said plurality of first threads has substantially equidistant engagement points, said guiding channel inner wall having a length extending in a substantially vertically downward direction sufficient to define a first sealing surface such that a portion of said first sealing surface and said plurality of first threads are located substantially in a common horizontal plane, said sealing member inner wall having a plurality of second threads adapted and positioned to cooperate with said first threads, wherein said plurality of second threads are discontinuous around the sealing member inner wall, and said plurality of second threads comprises at least two threads, said sealing member inner wall having a length extending in a substantially vertically downward direction sufficient to define a second sealing surface such that a portion of said second sealing surface and said plurality of second threads are located substantially in a common horizontal plane, wherein sealable engagement of said guiding channel and sealing member is effectuated when said first and second threads are in a first position with said first sealing surface in contact with said second sealing surface over a substantial length thereof.

22. The closure system of claim 21, wherein each of said plurality of first threads comprises a raised projection that projects outwardly from said guiding channel inner wall.

23. The closure system of claim 22, wherein each of said plurality of second threads comprises a guide adapted to receive one of said plurality of first threads.

24. The closure system of claim 21, wherein each of said plurality of second threads comprises a raised projection that projects inwardly from said sealing member inner wall.

25. The closure system of claim 24, wherein each of said plurality of first threads comprises a guide adapted to receive one of said plurality of second threads.

26. A closure system for closing an opening in a container, the container having a sealing member adjacent the opening, comprising:

a substantially U-shaped circumferentially extending guiding channel defined by an inner wall and an outer wall that are located and configured to receive between them the sealing member of the container, said sealing member having a corresponding configuration as said guiding channel and including an inner wall and an outer wall, said guiding channel inner wall and said container sealing member inner wall being tapered in the range of approximately 5-30°, said guiding channel outer wall having a plurality of first threads, wherein said plurality of first threads are discontinuous around the guiding channel outer wall, said plurality of first threads comprises at least two threads and said plurality of first threads has substantially equidistant engagement points, said guiding channel inner wall having a length extending in a substantially vertically downward direction sufficient to define a first sealing surface such that a portion of said first sealing surface and said plurality of first threads are located substantially in a common horizontal plane, said sealing member outer wall having a plurality of second threads adapted and positioned to cooperate with said first threads, wherein said plurality of second threads are discontinuous around the sealing member outer wall, and said plurality of second threads comprises at least two threads, said sealing member inner wall having a length extending in a substantially vertically downward direction sufficient to define a second sealing surface such that a portion of said second sealing surface and said plurality of second threads are located substantially in a common horizontal plane, wherein sealable engagement of said guiding channel and sealing member is effectuated when said first and second threads are in a first position with said first sealing surface in contact with said second sealing surface over a substantial length thereof.

27. The closure system of claim 26, wherein said guiding channel and said sealing member comprise a polymeric material.

28. The closure system of claim 27, wherein said guiding channel and said sealing member comprise thermoformed members.

29. A closure system for closing an opening in a container, the container having a sealing member adjacent the opening, comprising:

a substantially U-shaped circumferentially extending guiding channel defined by an inner wall and an outer wall that are located and configured to receive between them the sealing member of the container, said sealing member having a corresponding configuration as said guiding channel and including an inner wall and an outer wall, said guiding channel inner wall and said container sealing member inner wall being tapered in the range of approximately 5-30°, said guiding channel inner wall having a plurality of first threads, wherein said plurality of first threads are discontinuous around the guiding channel inner wall, said plurality of first threads comprises at least two threads and said plurality of first threads has substantially equidistant engagement points, said guiding channel inner wall having a length extending in a substantially vertically downward direction sufficient to define a first sealing surface such that a portion of said first sealing surface and said plurality of first threads are located substantially in a common horizontal plane, said sealing member inner wall having a plurality of second threads adapted and positioned to cooperate with said first threads, wherein said plurality of second threads are discontinuous around the sealing member inner wall, and said plurality of second threads comprises at least two threads, said sealing member inner wall having a length extending in a substantially vertically downward direction sufficient to define a second sealing surface such that a portion of said second sealing surface and said plurality of second threads are located substantially in a common horizontal plane, wherein sealable engagement of said guiding channel and sealing member is effectuated when said first and second threads are in a first position with said first sealing surface in contact with said second sealing surface over a substantial length thereof.

30. The closure system of claim 29, wherein said guiding channel and said sealing member comprise a polymeric material.

31. The closure system of claim 30, wherein said guiding channel and said sealing member comprise thermoformed members.

* * * * *